United States Patent [19]

Watanabe et al.

[11] 4,139,042

[45] Feb. 13, 1979

[54] SHUTTER DEVICE

[75] Inventors: Masanori Watanabe, Yono; Yoshiaki Akima, Akikawa; Kazuyuki Hijikata, Hino, all of Japan

[73] Assignee: Japan New Plate Hokusho Industrial Co. Ltd., Tokyo, Japan

[21] Appl. No.: 908,822

[22] Filed: May 23, 1978

Related U.S. Application Data

[63] Continuation of Ser. No. 753,853, Dec. 13, 1976, abandoned.

[51] Int. Cl.[2] ..... E06B 9/26

[52] U.S. Cl. ..... 160/36

[58] Field of Search ..... 160/32, 33, 35, 36, 160/193, 197, 202, 222, 223

[56] References Cited

FOREIGN PATENT DOCUMENTS 224432 10/1959 Australia ..... 160/36

*Primary Examiner*—Peter M. Caun

*Attorney, Agent, or Firm*—Sherman & Shalloway

[57] ABSTRACT

A shutter device for covering or screening a door or window of buildings is disclosed. The shutter device is composed of a plurality of slats adapted to be continuously arranged in a same plane when the slats are supported by guide rails arranged at both sides thereof. Each slat is connected through a link mechanism to adjacent slat such that, in the case of enclosing each slat in a slat enclosing region, when each slat reaches to a conversion region located at one end of a supporting surface formed by a guide rail, each slat is moved laterally in front of or in the rear of the supporting surface to provide a space which permits a succeeding slat to enter into the conversion region and that, in the case of delivering each slat from the slat enclosing region, when each slat is moved from the conversion region along the supporting surface of the guide rail, the succeeding slat is pulled into the conversion region. The movement of each slat is accomplished by a driving mechanism which functions to pull the slat supported by the guide rail into the conversion position or deliver a slat existing in the conversion region therefrom along the guide rail.

10 Claims, 10 Drawing Figures

SHUTTER DEVICE

This is a continuation of application Ser. No. 753,853, filed Dec. 13, 1976, now abandoned.

FIELD OF THE INVENTION

This invention relates to a shutter device for covering or screening a door or window of buildings.

BACKGROUND OF THE INVENTION

A most general type of shutter device comprises a shutter unit composed of a number of slats rotatably connected with each other, a winding mechanism for winding the shutter unit, and a guide rail arranged at both sides of an opening such as a window, etc. and for guiding the shutter unit. The slat for constituting the shutter unit is generally formed of an elongate steel sheet and connected to adjacent slat such that each slat can rotate by a given angle with respect to the adjacent slat. Such bending function makes it possible to wind the shutter unit around a take-up shaft into a roll-shaped body. The rotary movement between adjacent slats results in friction or collision between adjacent slats or between the slat and its guide rail. Such friction or collision tends to produce a noise when the shutter unit is closed and opened or when the closed shutter unit is subjected to the wind.

SUMMARY OF THE INVENTION

An object of the invention is to provide a shutter device which can significantly reduce a noise produced when the shutter unit is closed and opened to move the slat and when the slat becomes oscillated due to the external causes such as wind, etc.

Another object of the invention is to provide a shutter device which can enlarge a height of each slat, that is, an area of each slat having a given width.

A further object of the invention is to provide a shutter device comprising a driving mechanism which can move each slat in a smooth and reliable manner.

A feature of the invention is the provision of a shutter device comprising a pair of guide rails spaced apart by a given distance from each other and arranged in parallel with each other so as to form a flat supporting surface; a plurality of slats engaged at both ends thereof with each guide rail and movable along said supporting surface; a slat enclosing means defining a slat enclosing region communicated through a conversion region located at one end of said supporting surface with said supporting surface and extending in a direction perpendicular to said supporting surface, said slat enclosing region enclosing each slat with its front surface faced toward the rear surface of adjacent slat; a link means for connecting each slat to adjacent slat such that when each slat enters from said supporting surface into said conversion position a slat existing in said conversion region is moved toward said slat enclosing region and that when each slat is delivered from said conversion region the slat existing in the slat enclosing region is pulled out into said conversion region; and a driving means for selectively accomplishing either one of the movement of causing each slat to be entered into said conversion region and the movement of causing a slat existing in said conversion region to be removed out thereof.

In short, in the shutter device according to the invention, when each slat is displaced from its spread out condition on a flat supporting surface formed by a guide rail to its enclosed condition in a slat enclosing region and vice versa, each slat is not rotated with respect to adjacent slat but its direction of movement only is converted. Such conversion of the direction of movement of each slat is carried out at a conversion region located at a position where the supporting surface and the slat enclosing region cross with each other. The movements of each slat along the supporting surface and in the slat enclosing region as well as the conversion of the direction of movement of each slat in the conversion region are accomplished by merely moving each slat in a direction parallel with the supporting surface.

Means of connecting each slat to adjacent slat in a manner such as that the above mentioned conversion of the direction of movement of each slat can be carried out is composed of a lever mechanism having a lever arranged at both sides of each slat. Each lever has its one end rotatably supported by one end of a side surface of each slat and another end rotatably connected to adjacent slat and movable from the upper end of the adjacent slat to the lower end thereof. The lever mechanism is capable of moving each slat in a direction parallel with adjacent slat and connecting each slat to adjacent slat such that when the slats are arranged in the same plane each slat is not separated from adjacent slat by a distance exceeding a given value.

The shutter device according to the invention is characterized in that, in the case of moving slats connected in the above mentioned relation, a slat existing at a conversion position located at one end of the guide rail is moved. This characteristic feature can simplify a driving mechanism required for moving each slat in construction and accomplish closing and opening operations of the shutter unit in a quiet and smooth manner.

BRIEF DESCRIPTION OF THE DRAWINGS

The invention will now be described in greater detail with reference to the accompanying drawings, wherein.

DESCRIPTION OF PREFERRED EMBODIMENTS

Figure 1:
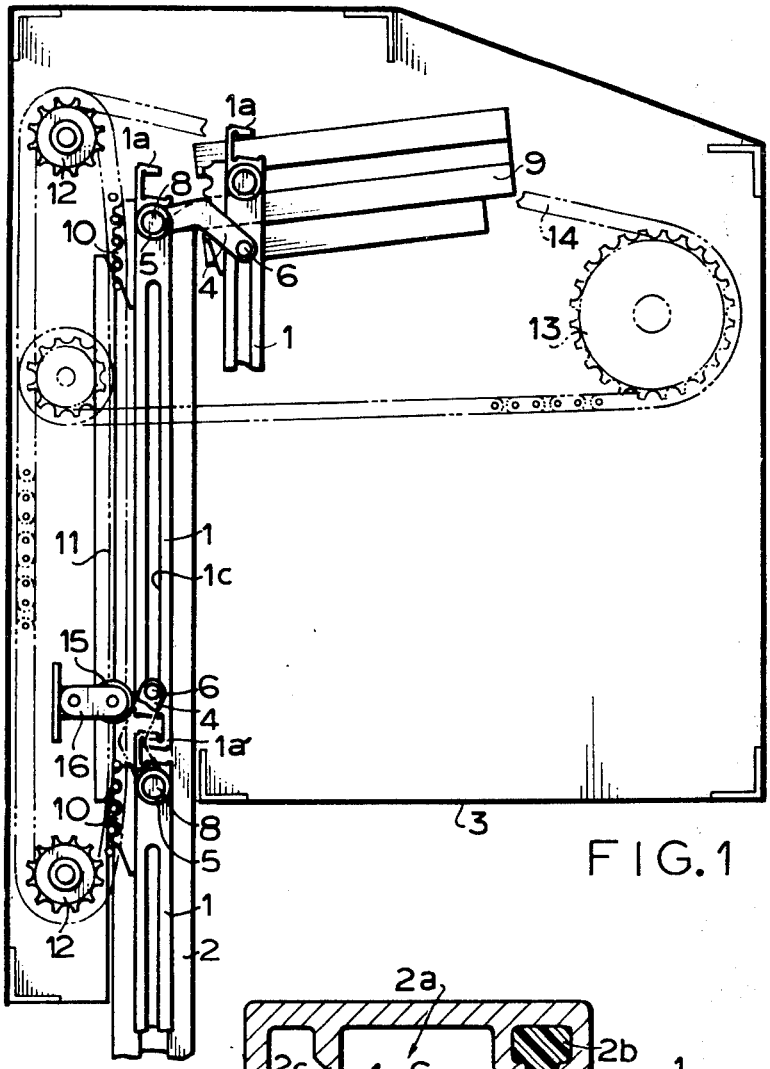
FIG. 1 is a side elevational view showing one embodiment of the shutter device according to the invention, partly broken away.

Referring to FIG. 1, reference numeral 1 designates a plurality of slats connected with each other in a given relation to constitute a shutter unit for closing openings such as a door or window of buildings. Each of these slats 1 is constituted by a rectangular frame formed of a light metal such, preferably, as aluminium and a suitable panel secured thereto and slidably engaged at its both ends with a flat supporting surface of a pair of guide rails 2 arranged at both sides of the opening of the building.

At the upper end of the guide rail 2 is arranged a slat enclosing region or a box 3 extending in a direction perpendicular to the flat supporting surface of the guide rail 2 (in the present embodiment, substantially horizontal direction).

The flat supporting surface of the guide rail 2 is communicated through a conversion region located at the upper portion thereof with the box 3.

Each slat is connected at its both ends to an adjacent slat 1 by means of a lever mechanism including a lever 4. In addition, each slat 1 is provided at its upper and lower ends with engage portions 1*a* and 1*a'* so formed as to be engaged with engage portions 1*a* ' and 1*a* of an adjacent slat 1, respectively. The lever mechanism and engage portions 1*a* and 1*a* ' will be described in greater detail.

Figure 2:
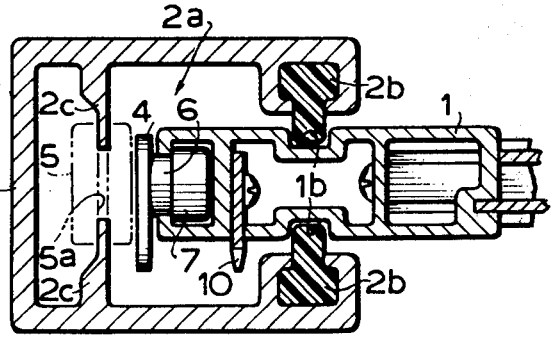
FIG. 2 is a cross-sectional view showing a guide rail and one of slats supported by the guide rail of the shutter device shown in FIG. 1.

As shown in detail in FIG. 2, the guide rail 2 is provided with a guide groove 2*a* into which is projected the edge portion of each slat 1. It is preferable that the guide groove 2*a* is provided at its opposed surfaces with a pair of limit members 2*b*, 2*b* for the purpose of moving the slat 1 along the guide rail 2 in a smooth manner and reducing noise caused by friction and collision between the slat 1 and the guide rail 2. Each limit member 2*b* is extended in a lengthwise direction of the guide groove 2*a* and slidably engaged at its opposed free end with an engage groove 1*b* provided in each slat 1. The guide rail 2 is provided at the opposed surfaces of the guide groove 2*a* with a pair of ridges 2*c*, 2*c* projecting inwardly from the guide groove 2*a* and made integral therewith. The ridge 2*c* is brought into engagement with a groove 5*a* of a grooved roller 5 rotatably journalled in each slat 1 so as to precisely define the position of the slat 1 with respect to the guide rail 2.

The slat 1 is provided at its both ends with an elongate groove 1*c* in which is rotatably journalled a roller 7 having a shaft 6 whose axis extends in parallel with that of the grooved roller 5. The roller 7 is made movable along the elongate groove 1*c* in its lengthwise direction. The above mentioned lever 4 is pivoted at its one end to the shaft 6 of the roller 7 and at its another end to a shaft 8 of the grooved roller 5.

The lever 4 is formed of a bent plate having two legs extending from a center thereof and inclined at a suitable angle with respect to each other. As a result, when two adjacent slats 1,1 are aligned on a straight line by means of the guide rail 2, the center portion of the lever 4 is projected forwardly from the front surface of the aligned slats 1, 1.

That part of the upper end of the guide rail 2 projected into the box 3 which is located in front of the ridge 2*c* is broken away, so that in this part of the guide rail 2 each slat is supported by the grooved roller 5 only and guided by the ridges 2*c*, 2*c*. One of the ridges 2*c* is connected to the front end of a supporting rail 9 arranged near the upper end of the box 3 and extending substantially horizontal direction. As a result, in the box 3 each slat 1 is suspended at its upper end from the grooved guide roller 5 supported by the supporting rail 9. Under such suspended condition, each slat 1 tends to fluctuate and collide with each other thus producing a noise. In order to prevent such noise, the box 3 may be provided therein with a friction member such as brush, etc. whose front end is made in contact with the side surface of each slat 1.

In the box 3 is arranged an endless chain 11 having an engaged surface opposed to the slat 1 located at its conversion position. The endless chain 11 is wound across a pair of sprocket wheels 12, 12 so as to bring the engage surface thereof into engagement with a short rack 10 provided at the upper end of the slat 1. When one of the sprocket wheels 12 is driven through a chain 14 by a driving sprocket wheel 13 in one or opposite direction, the engage surface of the endless chain 11 is moved upwardly or downwardly and functions to move upwardly or downwardly the slat 1 having the rack 10 engaged with the engage surface of the endless chain 11. The engage surface of the endless chain 11 has a length selected such that immediately before the rack 10 of the slat 1 is separated from the endless chain 11, the rack 10 of the next succeeding slat 1 becomes engaged with the engage surface of the endless chain 11. That is, the rack 10 of at least one slat 1 is always engaged with the endless chain 11.

An opening operation of the shutter unit, that is, an operation of enclosing each slat 1 into the box 3 can be accomplished by moving the endless chain 11 in a direction such that the engage surface thereof is moved upwardly. This movement of the endless chain 11 causes the slat 1 having the rack 10 engaged with the endless chain 11 to move upwardly along the guide rail 2 and enter into the box 3. In this case, all of the succeeding slats 1 each connected to the lower end of the previous slat 1 are also raised along the guide rail 2.

At the final stage when the uppermost slat 1 enters into the box 3, the projecting portion of the lever 4 located at the lower end of the uppermost slat is brought into engagement with a push roller 15. As a result, the lever 4 causes the front surface of the slat 1 to be subjected to a pushing force in a direction perpendicular thereto, thereby enclosing the slat 1 into the box 3. The above mentioned successive steps of moving the slat 1 are shown in FIG. 3*a* to FIG. 3*d*.

The push roller 15 is rotatably supported by a free end of an arm 16 pivoted at the box 3 and biased by a spring (not shown) such that the push roller 15 is not moved when it is urged upwardly in the lengthwise direction of the guide rail 2, but is moved away from the passage way of the lever 4 when it is urged downwardly.

Figures 3A, 3B, 3C, 3D, 4A, 4B:
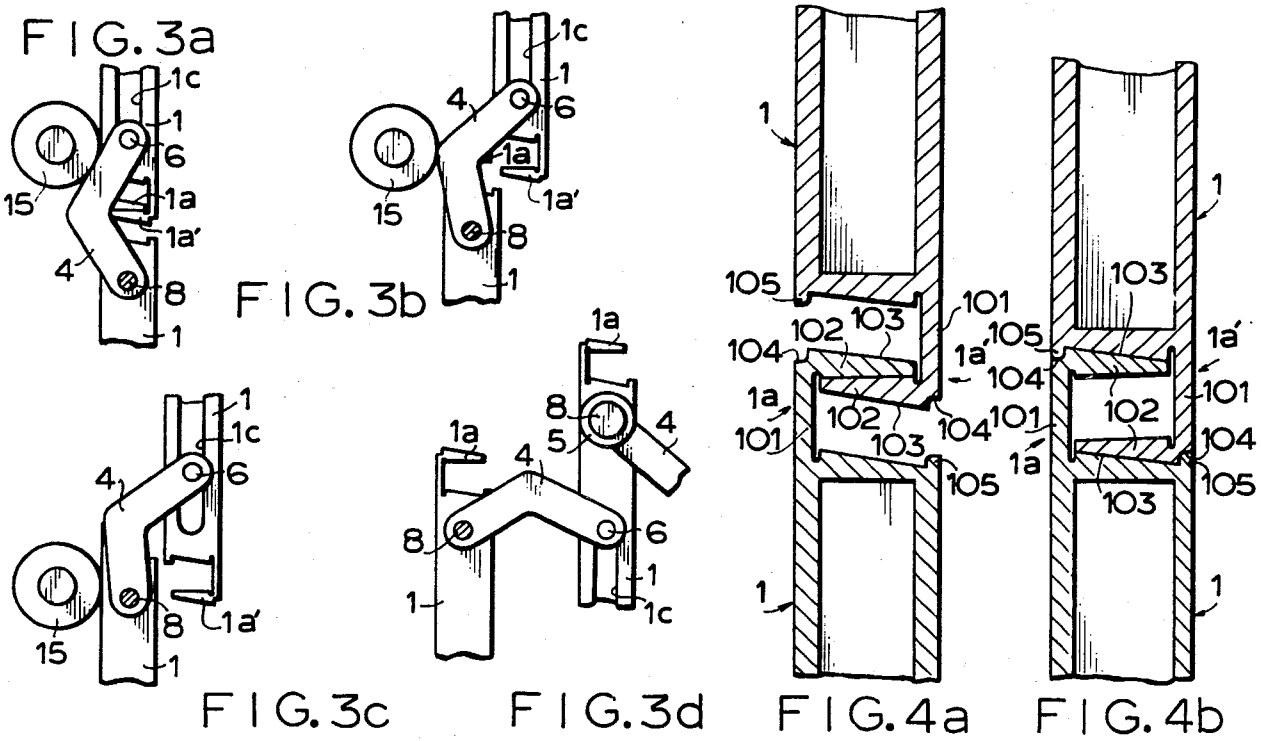
FIGS. 3*a* to 3*d* are side elevational views showing successive steps of moving a lever in a conversion region.
FIG. 4*a* is a partial longitudinal cross-sectional view showing an engage relation between two adjacent slats when a shutter unit is moving.
FIG. 4*b* is a partial longitudinal cross-sectional view showing an engage relation between two adjacent slats when a shutter unit reaches to its closed position.

As a result, if the lever 4 is further raised from a position shown in FIG. 3*a* in which the projecting portion of the lever 4 makes contact with the push roller 15, the lever 4 causes the lower end of the uppermost slat 1 to be pushed to the right in FIG. 1. That is, the lower end of the uppermost slat 1 is pushed into the box 3 and moved backwardly from the passage way of the succeeding slat 1, thereby permitting the succeeding slat 1 to raise. As a result, the succeeding slat 1 is raised with respect to the slat enclosed in the box 3 and the roller 7 is raised through the elongate groove 1*c*. If the roller 7 reaches to the upper end of the elongate groove 1*c*, a relative movement between these two slats 1, 1 causes the lever 4 to rotate about the shaft 6 as a center by 180° in a clockwise direction in FIG. 1 thus pushing the slat 1 enclosed in the box 3 toward the inside thereof. This operation is repeated every time the succeeding lever 4 comes into contact with the push roller 15 to enclose each slat 1 in succession into the box 3.

Operation of deliverying each slat 1 out of the box 3 can be accomplished by moving the endless chain 11 in a direction opposite to the above mentioned direction. In this case, a slat 1 having a rack 10 engaged with the endless chain 11 becomes lowered along the guide rail 2. When the roller 7 reaches to the lower end of the elongate groove 1*c*, the roller 7 is rotated about 180° in a counterclockwise direction to pull out the succeeding slat 1 from the box 3 and cause the rack 10 thereof to be engaged with the endless chain 11.

Each of the engage portion 1*a* provided at the upper end of each slat 1 and the engage portion 1*a'* provided at the lower end of each slat 1 has a width which is substantially equal to the overall width of each slat 1 and a cross-section shown in detail in FIG. 4. The engage member 1*a* provided at the upper end of each slat 1 is provided with a vertical portion 101 having a given height and extending in a direction which is substantially parallel with the front or rear surface of the slat 1 and with a horizontal portion 102 extending from the upper end of the vertical portion 101 in a horizontal direction. The horizontal portion 102 is provided at its outer surface with a flat contact surface 103 and with a groove or depression 104 at the end of the surface 103 next to the portion 101. Each slat 1 is provided at that portion thereof which is opposed to the recess 104 with a projection 105 adapted to be engaged with the recess 104. The engage member 1*a'* provided at the lower end of each slat 1 is made similar in construction to the above mentioned engage member 1*a*, so that the description thereof is omitted by designating portions common to both two engage member 1*a*, 1*a'* by the same reference numerals.

In FIG. 4*a* is shown an operating condition in which successive slats 1, 1 are raised along the guide rail 2. In this operating condition, each slat 1 is supported by the guide rail 2 and separated a longest distance from each other by its own weight. As shown in FIG. 4*a*, the two adjacent engage members 1*a*, 1*a'* made contact at horizontal portions 102 and the projection 105 is not engaged with the depression 104. As a result, the movement of each slat 1 toward into or out of the box 3 toward the guide rail 2 in its thicknesswise direction can smoothly be carried out.

When the foremost slat 1 is stopped at its lowermost end of movement and the succeeding slat 1 still continues its downward movement, the distance between these two slats 1, 1 becomes shortened. As a result, the contact surfaces 103, 103 of the engage members 1*a*, 1*a'* are separated from each other and each projection 105 becomes engaged with each depression 104 as shown in FIG. 4*b*. This condition is remained as long as the lowermost slat 1 is prevented from being moved downwardly. In this condition, even through the upper or lower end of each slat 1 is pushed in its thicknesswise direction, no relative displacement between the two adjacent slats 1, 1 occurs and hence there is no risk of a gap being formed between these two slats 1, 1.

In the above mentioned embodiment, the depression 104 is provided in the engage member 1*a*, 1*a'*. Alternatively, the depression 104 may be provided in the slat 1 and the projection 105 may be provided in that position of the engage member 1*a*, 1*a'* which is opposed to the depression 104.

As can be seen from the above, the shutter device according to the invention is capable of moving all of the slats by merely moving a slat entered into a conversion position formed between a slat supporting surface and a slat enclosing region with the aid of a rack-chain engagement. During this movement of slats, the slats are not rotated. The use of such mode of operation ensures a quiet and smooth movement of each slat and provides the important advantage that a driving mechanism can be simplified.

In addition, each slat supported by a guide rail is pushed from its lower end and moved upwardly when a slat in the conversion position is entered into the slat enclosing region. As a result, after the uppermost slat has reached to the end of movement thereof, all of the slats supported by the supporting surface are subjected to the pushing force applied to the lowermost slat and brought into engagement with an upper slat under pressure. In this condition, each slat is firmly connected to adjacent slat to constitute a shutter unit having a strength which is equivalent to that of a single integral shutter construction.

When all of the slats are enclosed in the slat enclosing region, the guide rail becomes irrelevant to the other elements of the shutter device. So, the guide rail may be removed from the shutter device until the slats are lowered for next time, if necessary.

Figure 5:
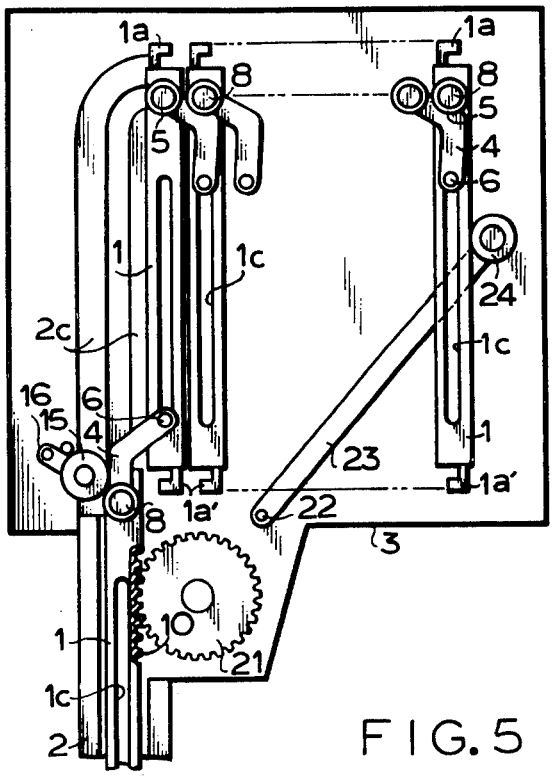
FIG. 5 is a side elevational view showing another embodiment of the shutter device according to the invention, partly broken away.
Figure 6:
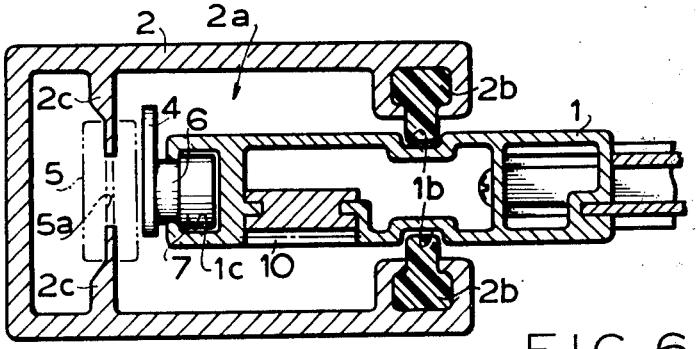
FIG. 6 is a cross-sectional view showing a guide rail and one of slats supported by the guide rail of the shutter device shown in FIG. 5.

In FIGS. 5 and 6 is shown another embodiment of the shutter device according to the invention. In the present embodiment, a driving mechanism for moving slats 1 in the conversion position thereof comprises a pair of racks 10 secured to each slat 1 and extending from the upper end to the lower end thereof, a pair of pinions 21 each provided in the box 3 and engaged with each rack 10, and a driving source such as the motor (not shown) for rotating the pinions 21. In FIGS. 5 and 6, the same or equivalent parts as or to those shown in FIGS. 1 and 2 are designated by the same reference numerals and the detailed description thereof is omitted. In the present embodiment, if the pinion 21 is rotated in one or opposite direction, the slats 1 are raised in succession and enclosed in the box 3 to open the opening of the building or delivered from the box 3 and lowered in succession to close the opening of the building in the same manner as in the previous embodiment.

Provision may preferably be made of a push mechanism which functions to push the slat 1 enclosed in the box 3 toward the swivel region thereof. The push mechanism comprises a rotary arm 23 having one end pivoted through a shaft 22 to the box 3, a roller 24 rotatably supported by a free end of the rotary arm 23 and a spring (not shown) for urging the rotary arm 23 in such a way that the roller 24 can push the slat 1 located at the innermost side of the box 3 toward the conversion region. The push mechanism functions to push a slat 1 located at the front end of the box 3 toward the conversion region and cause the slat 1 to enter into the conversion region in a smooth manner.

It is preferably to insert between the driving sprocket wheel 13 (FIG. 1) or the pinion (FIG. 5) and the driving source thereof a clutch mechanism which functions to automatically interrupt the transmission relation therebetween when a load subjected to the driving sprocket wheel 13 or the pinion 21 exceeds a preset value. Such clutch mechanism serves to prevent each slat or its driving mechanism from becoming damaged when the slat 1 becomes inoperative due to an accident and overload is subjected to the slat 1 or its driving mechanism.

What is claimed is:

1. A shutter device comprising: a pair of guide rails spaced apart by a given distance from each other and arranged in parallel with each other so as to form a flat supporting surface; a plurality of slats engaged at both ends thereof with each guide rail and movable along said supporting surface; a slat enclosing means defining a slat enclosing region communicated through a conversion position located at one end of said supporting surface with said supporting surface and extending in a direction perpendicular to said supporting surface, said slat enclosing region enclosing each slat with its front surface faced toward the rear end surface of adjacent slat; a connecting means for connecting each slat to an adjacent slat such that, when each slat enters from said supporting surface into said conversion position, a slat existing in said conversion region is deflected into said slat enclosing region and that, when each slat is delivered from said conversion region, the slat existing in the slat enclosing region is pulled out into said conversion region: a conversion means for effecting the conversion of each slat at said conversion position; and a driving means for selectively accomplishing either one of the movement of causing each slat to be entered into said conversion region and the movement of causing a slat existing in said conversion region to be removed wherein:

(a) said connecting means is comprised of a lever, one end of which is pivotably attached to the upper end of said slat and another end of which is slidably fitted to an elongated groove formed on an adjacent slat and the central portion of which projects from said supporting surface to form an engaging surface;

(b) said conversion means comprises a push means for engaging the engaging surface of said lever; and (c) each slat is provided at its upper and lower ends with engaging members in adjacent engagement when two adjacent slats are brought into contact with each other as a result of slat movement by said driving means.

2. The shutter device as claimed in claim 1 wherein said driving means is comprised of a rack provided on each slat and an endless chain running along an engaging surface corresponding to said conversion region and engaged with said rack when said slat reaches into said conversion region.

3. The shutter device as claimed in claim 1, wherein said driving means is composed of a rack provided on each slat, a pinion located at a position where a rack of a slat reached into said conversion region engages with said pinion, and a driving source for rotating said pinion.

4. The shutter device as claimed in claim 1, wherein each slat is provided at its upper and lower ends with engaging opposing projections which engage with those of an adjacent slat when two adjacent slats are brought into contact with each other.

5. The shutter device as claimed in claim 1 wherein said push means engages said levers such that when a respective slat enters said conversion region said push means causes said connecting means of the respective slat to engage said lever thereby disconnecting said engaging means.

6. The shutter device as claimed in claim 5 wherein said push means is comprised of a roller which is supported on a rotary arm to move from one position, at which said roller is placed in a passage of the engaging surface of said lever to push out the lower end of the slat existing in said conversion position when said slat is moved upwards, to another position when pushed out by said lever from said passage to permit said slat to be pulled into said conversion position.

7. The shutter device as claimed in claim 1 wherein said push means is comprised of a roller which is supported on a rotary arm to move from one position, at which said roller is placed in a passage of the engaging surface of said lever to push out the lower end of the slat existing in said conversion position when said slat is moved upwards, to another position when pushed out by said lever from said passage to permit said slat to be pulled into said conversion position.

8. The shutter device as defined in claim 7 wherein said driving means comprises a pair of racks fitted to said slat at both sides thereof and a pair of driven endless chains being engaged with said rack of the slat existing in said conversion region.

9. The shutter device as claimed in claim 8, wherein said driving means is composed of a rack provided on each slat, a pinion located at a position where a rack of a slat reached into said conversion region engages with said pinion, and a driving source for rotating said pinion.

10. The shutter device as claimed in claim 9, wherein each slat is provided at its upper and lower ends with engaging opposing projections which engage with those of an adjacent slat when two adjacent slats are brought into contact with each other.

* * * * *